US005309638A

United States Patent [19]

Farber et al.

[11] Patent Number: 5,309,638

[45] Date of Patent: May 10, 1994

[54] METHOD OF PRODUCING A PRESTRESSED REINFORCED CONCRETE STRUCTURE

[76] Inventors: Mark Farber, 20-66 W. 8 St. #6; Lyubov Kots, 19-63 74 St., both of Brooklyn, N.Y. 11223

[21] Appl. No.: 941,944

[22] Filed: Sep. 8, 1992

[51] Int. Cl.[5] ..... B21D 39/00

[52] U.S. Cl. ..... 29/897.34; 29/447; 29/452; 29/458; 52/223.14; 264/228

[58] Field of Search ..... 29/897.34, 447, 452, 29/458, 527.2; 52/223.1, 223.14; 264/228, 229

[56] References Cited

U.S. PATENT DOCUMENTS

| | | | |
|---|---|---|---|
| 3,552,074 | 1/1971 | Rajchman | 264/228 |
| 3,676,968 | 7/1972 | Campbell | 264/228 |
| 4,661,387 | 4/1987 | Watanabe et al. | 52/223.14 |
| 4,849,282 | 7/1989 | Watanabe et al. | 52/223.14 |
| 4,999,959 | 3/1991 | Virtanen | 52/223.14 |
| 5,093,065 | 3/1992 | Creedon | 264/228 |

*Primary Examiner*—Mark Rosenbaum
*Assistant Examiner*—David P. Bryant
*Attorney, Agent, or Firm*—I. Zborovsky

[57] ABSTRACT

A prestressed, reinforced concrete structure is made by applying a coating onto a reinforcing element, introducing the coated reinforcing element into the body of concrete, and heating the reinforcing element so that first the coating melts and a bond between the reinforcing element and the body of concrete is interrupted and the reinforcing element is expanded and thereafter heating the reinforcing element to a higher temperature at which the coating rigidifies and provides a firm bond between the expanded reinforcing element and the body of concrete.

5 Claims, 1 Drawing Sheet

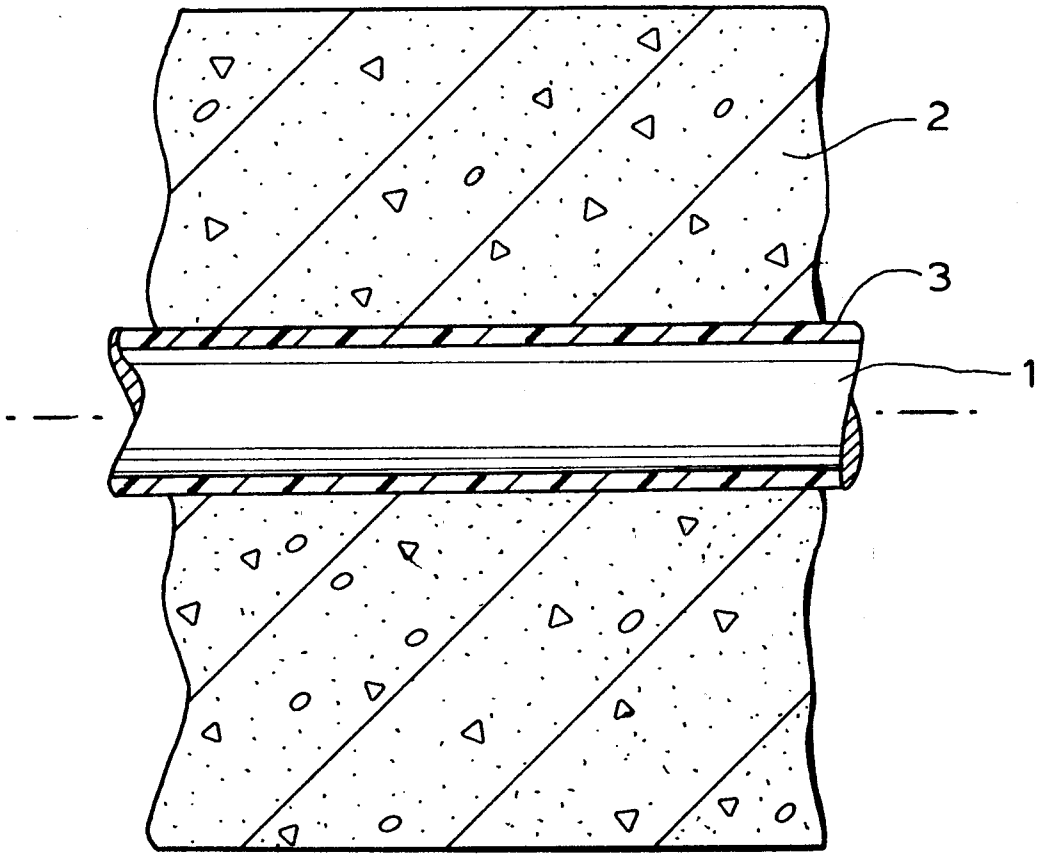
1
2
3

METHOD OF PRODUCING A PRESTRESSED REINFORCED CONCRETE STRUCTURE

BACKGROUND OF THE INVENTION

The present invention relates to prestressed reinforced concrete structures as well as to a method of producing such structures.

Prestressed reinforced concrete is well known for a long time and widely used in the construction industry. Conventional prestressed reinforced concrete structure includes a body of concrete, and a reinforcing element which is embedded in the body of concrete and prestressed, so as to provide a stress in the final structure. Constructions of prestressed, reinforced concrete structures are known and various methods of providing the prestress are known as well. It is well known to heat the reinforcing elements by electric current to provide a desired prestress. It is believed that further modifications and improvements of the existing prestressed reinforced structures and the method of their manufacture are desirable.

SUMMARY OF THE INVENTION

Accordingly, it is an object of the present invention to provide a prestressed reinforced concrete structure which is a further improvement of existing structures, and also a method of its manufacture which is further improvement of the existing methods.

In keeping with these objects and with others which will become apparent hereinafter, one feature of the present invention resides, briefly stated, in a prestressed reinforced concrete structure which has a body of concrete, a metal reinforcing element, and a plastic coating which coats the metal reinforcement and during heating of the metal reinforcement inside the concrete body first melts to interrupt the bond between the reinforcing element and the concrete structure and then rigidifies after the reinforcing element has been stretched under the action of heating.

In accordance with another feature of the present invention a method of producing a prestressed reinforced concrete structure is proposed in accordance with which a metal reinforcing element is produced, the reinforcing element is then coated with a plastic coating which under the action of heat first melts and then rigidifies, the reinforcing element coated with the plastic coating is introduced into a body of concrete, the reinforcing element together with the coating is heated so that the coating first melts and the bond between the reinforcing element and the body of concrete is interrupted and then the heating continues so that the reinforcing element stretches or expands under the action of heat, and after this the coating rigidifies so as to establish a firm bond between the prestretched or expanded reinforcing element and the body of concrete.

The novel features which are considered as characteristic for the invention are set forth in particular in the appended claims. The invention itself, however, both as to its construction and its method of manufacture will be best understood from the following description of preferred embodiments which is accompanied by the following drawings.

BRIEF DESCRIPTION OF THE DRAWINGS

The single FIGURE of the drawings is a view showing a prestressed reinforced concrete structure in accordance with the present invention and illustrates a method of its manufacture in accordance with the present invention.

DESCRIPTION OF THE PREFERRED EMBODIMENTS

In accordance with the present invention a prestressed reinforced concrete structure has a reinforcing element which is identified with reference numeral 1 and composed usually of metal, as well known in the art. It also has a body of concrete which is identified with reference numeral 2 and in which the reinforcing element 1 is embedded. Furthermore, the inventive structure has a coating which is identified with reference numeral 3 and located between the reinforcing element 1 and the concrete structure 2. Coating 3 is composed of a plastic material which under the action of heating first melts, and with a continuous heating hardens as a result of its polymerization.

The inventive prestressed reinforced concrete structure is produced and the method of its manufacture is implemented in the following manner. First, the reinforcing element 1 is coated with the plastic coating 3 in a known manner for example by passing through a bath containing such a plastic material for the coating 3. Then the reinforcing element 1 coated with the coating 3 is introduced in the body of concrete 2 also in a conventional manner which is not disclosed herein in detail since it is well known for persons of ordinary skill in this art.

The reinforcing element is then subjected to heating, for example by applying electric current to it. Under the action of electric current the reinforcing element 1 is heated, the heat is transferred to the coating 3, and the coating is melted. As a result of this the bond initially established between the metal reinforcing element and the body of concrete 2 is interrupted. During continuing heating the metal reinforcing element stretches or expands, as well known in the art, since it is no longer connected with the body of concrete 2. For a while, under the action of the heating the material of the coating 3 rigidifies and firmly connects the stretched or expanded reinforcing element 1 with the body of concrete 2, in the [reinforced] (1) condition of the reinforcing element 1. The bond is established over the whole length of the reinforcing element 1. When the reinforcing element 1 is subsequently cooled, it provides compression forces in the body of concrete, thus creating a prestressed, reinforced concrete structure (2).

In the above described method, the heating of the metal reinforcing element 1 can be performed under the action of electric current of low voltage approximately 35–70 Volt. After the body of concrete 2 with the reinforcing element 1 is rigidified, the heating of the reinforcing element 1 with the coating 2 can be performed to the temperature of approximately 170°–250° C., depending on the material of the coating 3. The first step of heating to approximately 40°–50° C. causes melting of the material of the coating 3, and then during a further increase of the temperature to 170°–250° C. the material rigidifies. When the material of the coating 3 rigidifies, a substantially high bond between the reinforcing element 1 and the body of concrete 2 is obtained substantially to 40–50 kg/cm$^2$. An example of a material for the coating 3 is presented hereinbelow.

The material includes the following components in weight particles:

(1) stretched (2) so that no additional anchoring of the reinforcing element in the concrete is needed

| | |
|---|---|
| First resin | 1.0 |
| Second resin | 3.0 |
| Urothropin | 0.4 |
| Quartz sand | 4.8 |
| Asbestos particles | 1.2 |

The first resin can include

| | | |
|---|---|---|
| | phenol | 80 g |
| | anilin | 20 g |
| | formaldehyde | 44.4 g |
| and | magnesium oxide | 2.0 g |

The second resin can include

| | | |
|---|---|---|
| | phenol | 100 g |
| | anilin | 98.9 g |
| | formaldehyde | 63.8 g |
| | ammonia water | 6.0 g |
| and | sulfuric acid | 0.15 g |

The process of prestressing described hereinabove and using electric heating is relatively simple and fast and can be completed in 1–1.5 minutes.

In accordance with another feature of the present invention the heating of the reinforcing element is performed during a relatively long time so as to provide warming up of the body of concrete in order to speed up its rigidification. When the concrete is sufficiently rigidified, the electric current is increased so that the material of the coating 3 is heated to the value which causes its rigidification. It is to be understood that the rigidification of the plastic material of the coating is performed due to its polymerization. In this advantageous method, the heating of the reinforcing element with the coating is first performed to 50°–70° C., this temperature is maintained during 24–36 hours to warm up the body of concrete and to speed up its rigidification, and then the electric current is increased so as to heat the reinforcing element to 170°–250° C. and to rigidify the material of the coating. Electric current is then turned off and the process of cooling starts. During the cooling the reinforcing element is being compressed and compresses the body of concrete.

It will be understood that each of the elements described above, or two or more together, may also find a useful application in other types of constructions and methods differing from the types described above.

While the invention has been illustrated and described as embodied in a prestressed reinforced concrete structure, and method of producing the same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters patent is set forth in the appended claims.

1. A method of producing a prestressed, reinforced concrete structure, comprising the steps of providing a metal reinforcing element; coating said reinforcing element with a coating composed of such a material which under the action of heating is first melted and then rigidifies during heating to a higher temperature; introducing said reinforcing element coated with the coating into a freshly poured body of concrete and establishing a bond between the reinforcing element and a concrete; initially heating said reinforcing element with the coating to a first temperature such that the reinforcing element expands the coating melts, and the bond established between the reinforcing element and the concrete through the coating is interrupted; and subsequently heating the reinforcing element to a second higher temperature so that the coating rigidifies and the expanded reinforcing element becomes bonded with the body of concrete through the rigidified coating.

2. A method as defined in claim 1, wherein said first temperature is approximately 50°–70° C., while said second temperature is approximately 170°–250° C.

3. A method as defined in claim 1, wherein said reinforcing element is heated by applying electric current thereto.

4. A method as defined in claim 1, wherein said initial heating is performed over such a time that the body of concrete is warmed up so as to speed up its rigidification.

5. A method as defined in claim 4, wherein said initial heating is performed over 24–48 hours.

* * * * *